United States Patent [19]

Cosman

[11] 4,162,577

[45] Jul. 31, 1979

[54] PENDULUM DRAWING MACHINE

[76] Inventor: Michael A. Cosman, 5175 Shalee St., Kearns, Utah 84118

[21] Appl. No.: 846,631

[22] Filed: Oct. 31, 1977

[51] Int. Cl.[2] ..... B43L 11/06; B43L 9/20

[52] U.S. Cl. ..... 33/27 L

[58] Field of Search ..... 33/27 L

[56] References Cited

U.S. PATENT DOCUMENTS

| | | | |
|---|---|---|---|
| 1,869,951 | 8/1932 | Worthington | 33/27 L |
| 3,324,556 | 6/1967 | Everett | 33/27 L |
| 3,494,037 | 2/1970 | Arber | 33/27 L |
| 4,063,285 | 12/1977 | Nagaoka | 274/23 R |

*Primary Examiner*—Harry N. Haroian

*Attorney, Agent, or Firm*—Criddle, Thorpe & Western

[57] ABSTRACT

A pendulum-actuated drawing instrument having at least two pendulums mechanically coupled with a scribing device by means of interconnected arms extending parallel to and above a support. The arms are universally pivottably connected and attached to the pendulums by means of nonextensible resilient rods.

16 Claims, 4 Drawing Figures

PENDULUM DRAWING MACHINE

BACKGROUND OF THE INVENTION

This invention relates to improvements in a pendulum drawing machine. More specifically, it relates to improvements in the joint and mounting means for such machines.

Pendulum drawing machines are known in the art. See, for example, U.S. Pat. Nos. 1,869,951; 3,143,807; 3,324,556; 3,494,037; and 3,977,085. A pendulum drawing machine is used for making various designs on a sheet of paper positioned on a base such as a table surface. Basically, the machine comprises two vertically positioned pendulum arms having weighted ends, a mounting means for pivotally mounting the pendulum arms to a table or other base, a pivot means for pivotally supporting the pendulum arms on the mounting means, two horizontal arms pivotally attached at each of their ends to the vertical pendulum arms and attached at their opposite ends to a penholder, which holds a pen for drawing designs on the sheet. One of the horizontal arms usually is pivotally attached to the penholder.

The pendulum drawing machine creates drawings of a geometrical nature by combining the motion of the two independent driving forces—the pendulum arms. Each pendulum arm oscillates at a rate determined by its length and the position of the weight affixed to its bottom end. As each pendulum swings, the top of the arm (which is above the pivot axis) moves back and forth. The pendulums are pivotally mounted so that they swing at right angles to each other, and are positioned such that the two horizontal arms meet at right angles at the penholder. The arm joints and pivots allow the penholder to describe a path which is the sum of the two motions of the horizontal arms. As the drawing progresses, the pendulum arms will swing back and forth, causing figures to be drawn as circles, ovals, straight lines or an infinite combination of these. The friction of the pen and assorted joints and pivots causes the motion of each pendulum to terminate slowly. The drawing thus produced slowly converges to a stationary point.

The above-cited patents describe machines which vary in the manner in which they are mounted to a horizontal surface or table, in the configuration of the pendulum arms, in the pivot means for pivotally attaching the pendulum arms to the horizontal surface, in the joint means for pivotally attaching the horizontal arms to the pendulum arms or to the penholder, or in other ways such as, for example, in U.S. Pat. No. 3,143,807, wherein a flexible wire is used for connecting each of the pendulum arms with the penholder, rather than rigid, horizontal arms. The machine of the present invention differs from all these prior patents in the joint means for attaching the horizontal arms to the pendulum arms and to the penholder and in the mounting means for mounting the pendulum arms to a table or horizontal surface.

The joint means of the prior patents are either crude (U.S. Pat. No. 1,869,951) or comparatively complex (U.S. Pat. Nos. 3,324,556 and 3,977,085). Moreover, several of the previously disclosed joint means have either less than or more than the desired degrees of freedom of the joint means of the present invention, as is described below. Moreover, the joint means of the present invention generally dissipate less energy through friction than do the means of the prior patents.

This allows the machine to operate for a longer period of time on a given energy input and thereby to produce more elaborate drawings.

The mounting means of the present invention comprises a board which can be placed diagonally across a corner of the horizontal surface or table. The board contains the pivot means which pivotally supports the pendulum arms on the mounting means. Thus, the drawing machine of the present invention can easily be positioned for use on almost any table without advance preparation. Additionally, this mounting means is simple in design and thus very economical.

In summary, the simple, but very efficient and effective, joint and mounting means of the present invention provide a pendulum drawing machine that is considerably less complex in design and less bulky in structure than those previously disclosed. Consequently, it is more economical and more easily packagable for sale. The simplicity of the present invention greatly enhances its economic appeal.

The advantages and objects of the invention will become further evident from the detailed description of the invention given below.

SUMMARY OF THE INVENTION

The present invention comprises a pendulum drawing machine for making various designs on a sheet positioned on a planar horizontal surface of a base, the machine comprising:

a. Two pendulum arms having weighted ends;

b. A mounting means for pivotally mounting the pendulum arms to the base, the arms being mounted in a vertical position relative to the planar surface of the base and positioned such that the weighted ends extend below the planar surface of the base and the unweighted ends extend above the planar surface;

c. A pivot means for pivotally supporting the pendulum arms on the mounting means;

d. Two horizontal arms;

e. Arms attaching or joint means for pivotally and rotationally attaching the horizontal arms to the ends of the pendulum arms extending above the planar surface of the base, the arms attaching means comprising a flexible, straight nonextensible and non compressible rod which (a) allows only limited rotation of the horizontal arms (1) about the axis of the horizontal arms, (2) about the axis of the pendulum arms, and (3) about an axis parallel to the pivot axis of the pendulum arms and which (b) prevents translational movement of the horizontal arms relative to the pendulum arms;

f. A penholder attached to the end of the horizontal arms opposite the ends attached to the arms attaching means, the penholder holding a pen for drawing designs on a sheet.

The present invention also comprises as a mounting means, a board that can be placed diagonally across a corner of the planar surface of a base and that contains the pivot means for pivotally supporting the pendulum arms on the mounting means.

The present invention further comprises as a penholder attachment means—a flexible, rectangular sheet material that allows the horizontal arm connected to the penholder attachment means to meet the penholder at continually varying angles but prevents translational movement of the penholder relative to the arm.

DETAILED DESCRIPTION OF THE INVENTION

Figure 1:
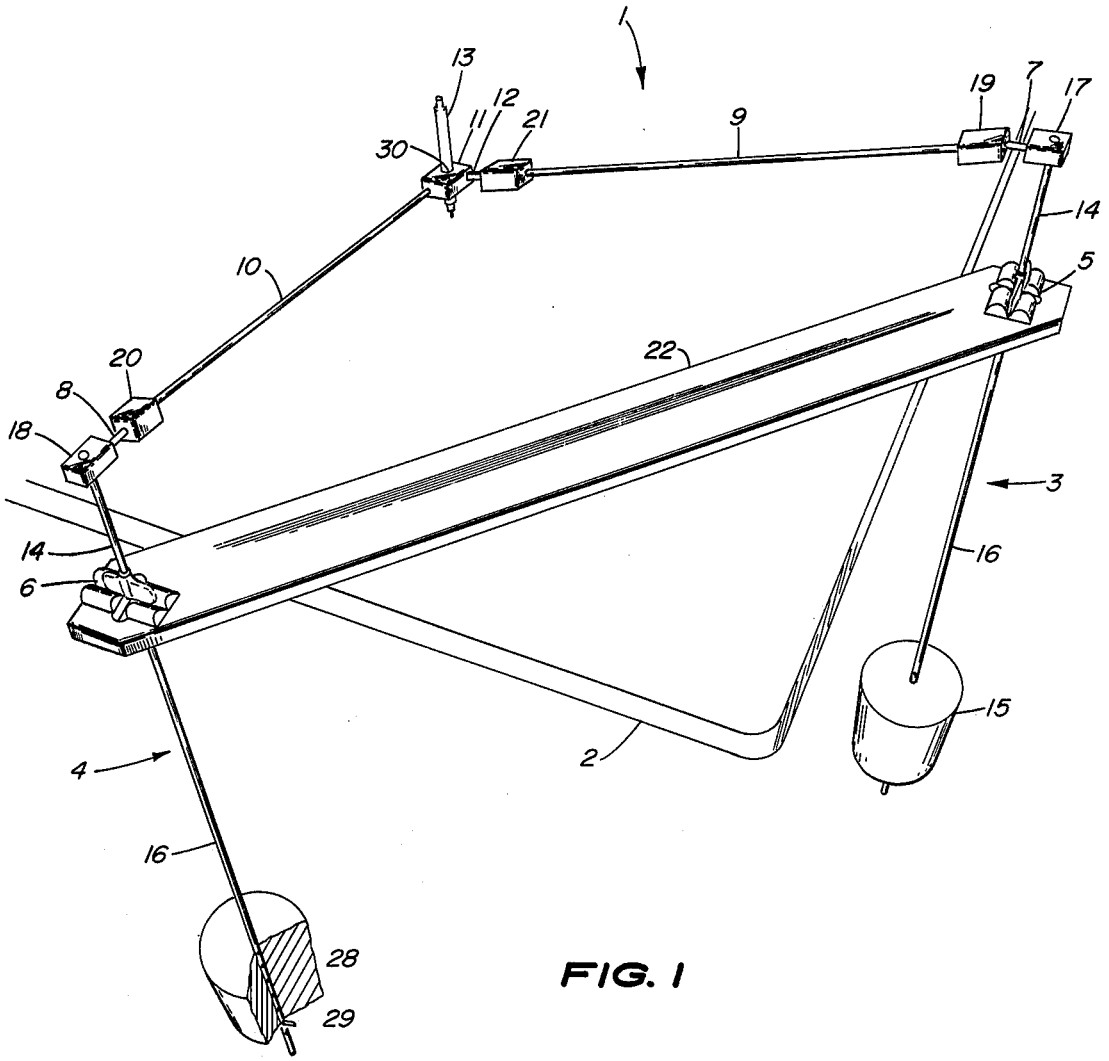
FIG. 1 is a perspective view of the drawing machine mounted on the top of a planar or horizontal surface of a base (table).

In FIG. 1, the pendulum drawing machine is designated by a general reference number 1. The machine 1 is mounted on a table 2 by a mounting means 22, which includes a first and second pivot means, 5 and 6. A first pendulum arm 3 is pivotally mounted to the table 2 through pivot means 5, and a second pendulum arm 4 is pivotally mounted to table 2 through pivot means 6. The pendulum arms are mounted in a vertical position relative to the planar surface of the table 2 and are positioned such that ends 16 extend below the planar surface of table 2 and ends 14 extend above. Ends 16 are weighted by first and second weights, 15 and 25, respectively.

Horizontal arms 9 and 10 are pivotally and rotationally attached to pendulum arms 3 and 4 by arms attaching means 7 and 8, respectively. Blocks or dowels 17 and 19 connect the arms attaching means 7 to pendulum arm 3 and to horizontal arm 9, respectively, and blocks or dowels 18 and 20 connect the arms attaching means 8 to pendulum arm 4 and to horizontal arm 10, respectively. Horizontal arm 10 is securely attached to penholder 11, which contains a pen 13. Horizontal arm 9 is pivotally attached to penholder 11 by a penholder attachment means 12, which is connected to horizontal arm 9 through a block or dowel 21.

Pendulum arms 3 and 4 are preferably each 33 inches long and made of ⅜ inch hardwood dowels; however, size and material can be varied as desired. Ends 14 extend above pivot means 5 and 6 approximately 1/6 of the length of the arms. Thus, ends 16 comprise approximately 5/6 of the length of the arms. Weights 15 and 25, attached to the bottom ends of arms 3 and 4, respectively, are preferably each about 3.5 pounds and are preferably cylindrical with a 7/16 inch hole through the center axis. They are approximately 3 inches in diameter by about 6 inches long and are preferably composed of plaster-of-paris; however, material and configuration can be varied as desired. For example, weights 15 and 25 could be collapsable containers that can be filled with a relatively dense material prior to use. Each weight can be raised or lowered relative to the bottom end of the penholder arms and to the other weight by sliding it vertically along the pendulum arm and inserting a nail or pin 29 through a hole 28 drilled in the pendulum arm to allow selective height adjustment. Preferably, the holes are closely spaced so that the weight can be raised in increments of ⅛ inch.

Figure 4:
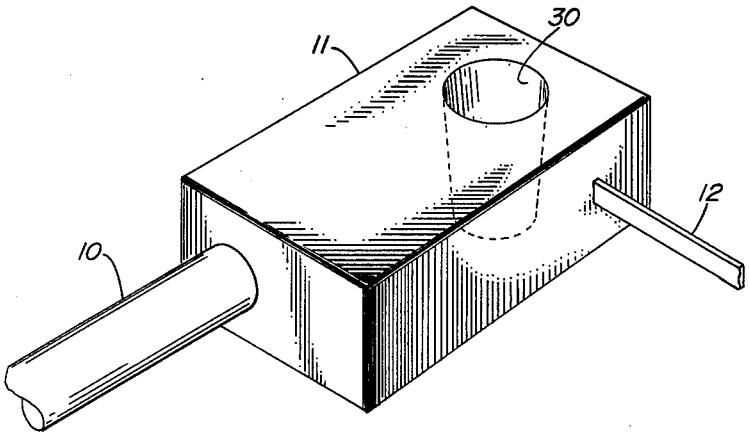
FIG. 4 is a perspective view of the penholder attachment means.

Horizontal arms 9 and 10 are preferably 18 inch in length of ¼ inch hardwood dowel. Other lengths and materials can be selected as desired. Horizontal arm 9 is securely attached, preferably friction-fitted, at its ends to blocks 19 and 21. Horizontal arm 10 is similarly attached to block 20 and penholder 11. Penholder 11 is preferably a wood block of approximately 1 inch by 1 inch by 2 inches with a tapered hole 30, as shown in FIG. 4, drilled to fit the common sizes of pens, preferably fibrous-tip pens. The hole is drilled so that a pen can be friction-fitted and held in a vertical position with about 1 inch of pen extending below the bottom of the penholder.

Figure 2:
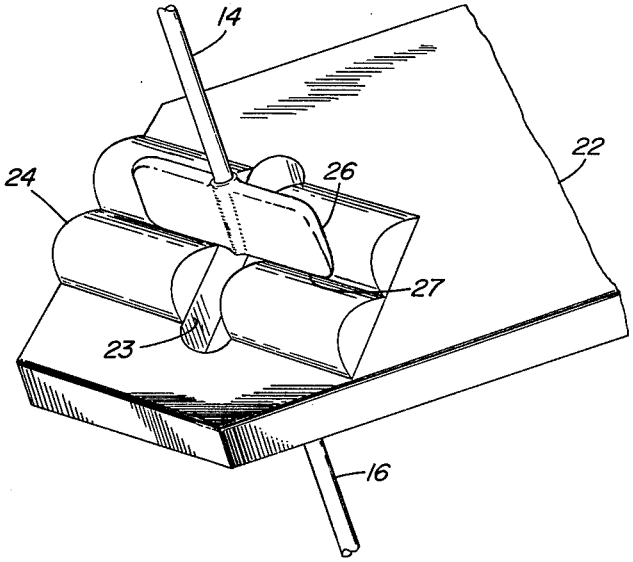
FIG. 2 is a perspective view of the pivot means.

The mounting means 22 is preferably a particle board about ½ inch thick, 32 inches long, and 3 inches wide. As shown in FIGS. 1 and 2, pivot means 6, which is identical to pivot means 5, comprises a slot 23 which is cut in each end of the mounting means 22. Slot 23 is preferably 1½ inch by 1 inch and should be of sufficient size to permit the pendulum arm to fit through with clearance so that it can swing freely. Slot 23 is positioned at a 45° angle to the length of the mounting means 22 and at a 90° angle to an identically shaped slot in pivot means 5. Attached to pendulum arm 4 is a knife-edge bearing 26 having a knife-edge 27. Bearing 26 is preferably nylon and is constructed so that the pendulum arm fits through a hole in the center of the bearing. Two pairs of knife-edge wings 24 are positioned on opposite sides of the center of slot 23 and form a V-groove to engage bearing 26 and allow for a pivoting action.

Preferably, two patches of 1/16 inch thick high-friction foam rubber sheets (not shown) are affixed to the bottom of the ends of mounting means 22 to prevent it from sliding across table 2 as the pendulum arms oscillate. Mounting means 22 is positioned diagonally across the corner of table 2 so that the pendulum arms each can clear the table edge as they oscillate. The main advantage of mounting means 22 is that it can be positioned on the corner of almost any table or horizontal surface and requires no installation time or physical modification of the table, as is required with some prior art machines. In addition, it is simple and easy to set up.

Figure 3:
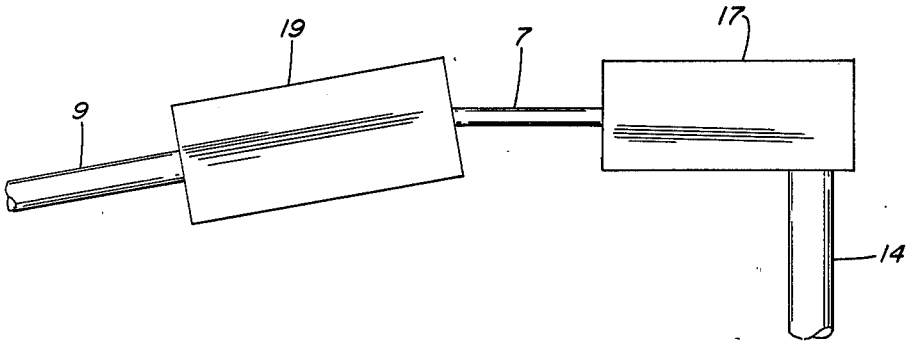
FIG. 3 is a side view of the arms connecting means.

Arms attaching means 7 is shown in FIG. 3 (arms attaching means 8 is identical) and is a flexible, straight nonextensible and non compressible rod having its ends embedded into blocks 17 and 19 as shown. The arms attaching means 7 and 8 pivotally and rotationally attach the horizontal arms to the ends 14 of the pendulum arms. It is found that a flexible, straight nonextensible and non compressible rod provides a highly effective and efficient joint between the horizontal and pendulum arms. It is simple, inexpensive, and durable, and it consumes minimal amounts of energy during a drawing operation.

A flexible, straight nonextensible and non compressible rod for the arms attaching means is particularly suited to provide for three limited degrees of freedom of the horizontal arms. These limited degrees of freedom are essential to an even, fluid motion of the drawing machine during operation. The three degrees of freedom are:

(a) Rotation of the horizontal arms about their axes, which rotation is limited to a few degrees in each direction, (b) Rotation of the horizontal arms about the axes of the pendulum arms, which rotation is limited to about 45° in each direction, and (c) Rotation about the axes parallel to the pivot axes of the pendulum arms, which rotation is limited to about 35° in each direction.

In addition, the flexible, straight nonextensible and non compressible rod prevents translational movement of the horizontal arms relative to the pendulum arms. The joint means of the prior patents either do not provide for these limited degrees of freedom of the horizontal arms in the manner described above or do not provide or control such movement as effectively as do the arms attaching means of the present invention.

The arms attaching means can be a metal wire, preferably a spring-steel piano wire about 2 inches in exposed length and from about 0.016 to about 0.044 inch in diameter. The preferred arms attaching means is a nylon rod preferably about 3/64 inch in diameter and about ½ inch in exposed length. As used herein, the term "rod" is not limited to a perfectly cylinderically-shaped body.

The penholder attachment means 12 is designed to allow horizontal arm 9 during operation to meet the penholder 11 at continually varying angles but to prevent translational movement of the penholder relative to horizontal arm 9. A preferred penholder attachment means is a, flexible, rectangular sheet material, preferably selected from a group which consists of nylon and metal. Preferably, the sheet material is nylon and is about 1/16 inch thick, about ¼ inch wide, and about ½ inch in exposed length. A penholder attachment means of this design and material is simple, inexpensive, and durable, and it consumes minimal amounts of energy during a drawing operation.

The pivot means 6 is designed to maintain the oscillation of the pendulum arms about a fixed axis. It must resist any sideways stresses on the pendulum arms, must remain fixed relative to the drawing sheet surface, must have little or no "backlash" (i.e., slack or looseness), and must have a low friction factor. The above-described low-friction knife-edge pivot works well, assuming the weights of pendulum weights 15 and 25 are not excessive. The knife-edge bearing 26 can be inexpensively made of plastic.

In operation, the pendulum arms 3 and 4 are manually set into an oscillatory motion about axes defined by the pivot means 5 and 6, respectively. The pendulum arms oscillate about the pivot means axes at a rate determined by their lengths and the positions of the weights 15 and 25 affixed to ends 16. As the pendulum arms swing, the tops 14 move back and forth thereby driving horizontal arms 9 and 10 through joint means or arms attaching means 7 and 8, respectively. Horizontal arm 10 and horizontal arm 9 (through penholder attachment means 12 in turn drive penholder 11 and thus pen 13 in a geometric design over the surface of a sheet of paper positioned beneath pen 13. The pendulum arms are pivotally mounted so that they swing at right angles to each other and are positioned such that the two horizontal arms meet at right angles at the penholder. The arms attaching means and pivot means allow the motion of the pendulum arms to be translated to the penholder in such a manner that the pen describes a path which is the sum of the two motions of the horizontal arms. Thus, as the pendulum arms oscillate, a drawing will be created in the form of a circle, oval, straight line, or an infinite combination of these. The friction of the pen and arms connecting means, penholder attachment means and pivot means causes the motion of each pendulum arm to terminate slowly. The drawing thus produced slowly converges to a stationary point. It is important to keep energy losses at a minimum during operation of the drawing machine, and the arms attaching means and the penholder attachment means of the present invention minimize such energy losses. This allows for elaborate, visually appealing drawings.

Normally, motion will be initiated by manually moving the penholder, which in turn initiates movement of the arms. With the pendulum arm weights exactly set to the same height, the pen will tend to continue describing its initial path. Raising the moveable weight causes successively faster phase changes of the two pendulum arms. When the pendulum arms are in phase, the figure traced is a straight line bisecting the angle between the two pendulum arms. When the pendulum arms are 90° out of phase, the figure is a somewhat distorted egg shape. When the pendulum arms are 180° out of phase, the path traced is a slightly curved line parallel to the imaginary line connecting the two pendulum pivot means. The actual path traced will merge from one of these to the others as the phases change.

The resulting figures are never perfectly symmetrical, but exhibit subtle distortions. This is because the angles connecting the pendulum arms, horizontal arms, and penholder fluctuate around 90°. Small swings of the pendulum arms will result in more symetrical figures, whereas larger swings will cause more pronounced distortions. An infinitely large machine drawing an infintesimally small drawing would produce exact circles and true straight lines.

The motion of each pendulum arm is not simple harmonic. That is, the period of the pendulum arm is partially determined by the magnitude of its swing. For small swings, the period could almost be considered to be independent of magnitude. The true period of the pendulum arm is described by a Taylor's series expansion, which means that the period is dependent upon the amplitude of oscillation. For large excursions this effect appears noticeably, causing the pendulums to change phase more rapidly initially when the swing is large. This effect can be used to obtain some interesting variations by using more weight on one pendulum arm than the other, thereby producing a Taylor induced phase lag to the intrinsic pendulum lag.

The above-described preferred design of the drawing machine optimizes the parameters for use of stock dowel sizes (about 36 inches), for practical angles of swing of the pendulum arms (about 35°), and for a mounting means which fits nicely on a typical table, all while producing designs which will about fill a standard 8½ inch by 11 inch sheet of paper. Accordingly, the economic appeal of the drawing machine is optimized.

Although the present invention has been described with reference to certain preferred embodiments, various modifications will be apparent to those skilled in the art and any such modifications are intended to be within the scope of the invention as set forth in the appended claims.

What is claimed is:

1. A pendulum drawing machine for making various designs on a sheet positioned on a planar horizontal surface of a base, the machine comprising:

a. Two pendulum arms having weighted ends;

b. A mounting means for pivotally mounting the pendulum arms to the base, the arms being mounted in a vertical position relative to the planar surface of the base and positioned such that the weighted ends extend below the planar surface of the base and the unweighted ends extend above the planar surface;

c. A pivot means for pivotally supporting the pendulum arms on the mounting means;

d. Two horizontal arms;

e. Arms attaching means for pivotally and rotationally attaching the horizontal arms to the ends of the pendulum arms extending above the planar surface of the base, the arms attaching means comprising a single, straight, nonextensible, noncompressible, resilient rod which (a) allows only limited rotation of the horizontal arms (1) about the axis of the horizontal arms, (2) about the axis of the pendulum arms, and (3) about an axis parallel to the pivot axis of the pendulum arms and which (b) prevents translational movement of the horizontal arms relative to the pendulum arms;

f. A penholder attached to the ends of the horizontal arms opposite the ends attached to the arms attaching means, the penholder holding a pen for drawing designs on a sheet.

2. A drawing machine according to claim 1 wherein the arms attaching means is a metal wire.

3. A drawing machine according to claim 2 wherein the metal wire is a spring-steel piano wire.

4. A drawing machine according to claim 3 wherein the wire is about 2 inches in length and from about 0.016 to about 0.044 inch in diameter.

5. A drawing machine according to claim 2 wherein the arms attaching means is a nylon rod.

6. A drawing machine according to claim 5 wherein the nylon rod is about 3/64 inch in diameter and about ½ inch long.

7. A drawing machine according to claim 1 wherein the mounting means is a board which can be positioned diagonally across a corner of the planar surface of the base and which contains the pivot means.

8. A drawing machine according to claim 1 wherein a first horizontal arm is attached to the penholder at a right angle to the second horizontal arm by a flexible, rectangular sheet material which allows the first horizontal arm during operation to meet the penholder at continually varying angles but prevents translational movement of the penholder relative to the first horizontal arm.

9. A drawing machine according to claim 8 wherein the sheet material is nylon.

10. A drawing machine according to claim 9 wherein the nylon is about 3/64 inch thick, about ¼ inch wide, and about ¼ inch long.

11. A drawing machine according to claim 8 wherein the sheet material is metal.

12. A drawing machine according to claim 1 wherein the mounting means contains the pivot means.

13. A pendulum drawing machine for making various designs on a sheet positioned on a planar horizontal surface of a base, the machine comprising:

a. Two pendulum arms having weighted ends;

b. A mounting means for pivotally mounting the pendulum arms to the base, the arms being mounted in a vertical position relative to the planar surface of the base and positioned such that the weighted ends extend below the planar surface of the base and the unweighted ends extend above the planar surface;

c. A pivot means for pivotally supporting the pendulum arms on the mounting means;

d. Two horizontal arms;

e. Arms attaching means for pivotally and rotationally attaching the horizontal arms to the ends of the pendulum arms extending above the planar surface of the base;

f. A penholder attached to the ends of the horizontal arms opposite the ends attached to the arms attaching means, the penholder holding a pen for drawing designs on a sheet.

g. A penholder attachment means for attaching a first horizontal arm to the penholder at a right angle to the second horizontal arm by a flexible, rectangular sheet material which allows the first horizontal arm during operation to meet the penholder at continually varying angles but prevents translational movement of the penholder relative to the first horizontal arm.

14. A drawing machine according to claim 13 wherein the sheet material is nylon.

15. A drawing machine according to claim 4 wherein the nylon is about 1/16 inch thick, about ¼ inch wide, and about ½ inch long.

16. A drawing machine according to claim 13 wherein the sheet material is metal.

* * * * *